US006257181B1

(12) United States Patent
Rosskamp et al.

(10) Patent No.: US 6,257,181 B1
(45) Date of Patent: Jul. 10, 2001

(54) TWO-STROKE ENGINE HAVING A VENTILATED TRANSFER CHANNEL

(75) Inventors: Heiko Rosskamp, Addberg; Lars Bergmann, Waiblingen, both of (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/644,715

(22) Filed: Aug. 24, 2000

(30) Foreign Application Priority Data

Aug. 25, 1999 (DE) ..... 199 40 180
Sep. 15, 1999 (DE) ..... 199 44 215

(51) Int. Cl.[7] ..... F02B 25/22

(52) U.S. Cl. ..... 123/73 AA; 123/73 PP; 123/65 P

(58) Field of Search ..... 123/73 PP, 73 R, 123/73 A, 73 AA, 74 A, 74 AA, 65 A, 65 P

(56) References Cited

U.S. PATENT DOCUMENTS 5,379,732 * 1/1995 Mavinahally et al. ..... 123/73 AA
5,628,295 * 5/1997 Todero et al. ..... 123/73 AA
5,899,177 * 5/1999 Binversie et al. ..... 123/65 PE
6,101,991 * 8/2000 Glover ..... 123/73 PP

FOREIGN PATENT DOCUMENTS 0 933 514 8/1999 (EP) .

* cited by examiner

*Primary Examiner*—Marguerite McMahon
(74) *Attorney, Agent, or Firm*—Walter Ottesen

(57) ABSTRACT

The invention relates to a two-stroke engine having a combustion chamber (3) configured in a cylinder (2). The combustion chamber is delimited by a piston (5) which moves upwardly and downwardly. The crankcase (4) is connected to the combustion chamber (3) via an transfer channel (14). A first end (20) of the transfer channel (14) opens into the combustion chamber (3) via an entry window (12) lying in the cylinder wall (16) and controlled by piston the (5). Between its ends (19, 20), the transfer channel (14) is connected to a gas channel (22) via a valve (21). The gas channel (22) essentially supplies fuel-free gas. The air/fuel mixture, which is necessary for the operation of the two-stroke engine, is supplied to the crankcase (4) via an inlet (11). In order to ensure a full charge of the transfer channel (14) with fuel-free gas, the entry window (12) of the transfer channel (14) is held open to the crankcase (4) in a stroke position of the piston (5) in the region of top dead center. The maximum cross section then corresponds only to a portion of the area of the entry window (12).

14 Claims, 3 Drawing Sheets

TWO-STROKE ENGINE HAVING A VENTILATED TRANSFER CHANNEL

FIELD OF THE INVENTION

The invention relates to a two-stroke engine which is used especially as a drive motor in a portable handheld work apparatus such as a motor-driven chain saw, brushcutter, cutoff machine, blower apparatus or the like.

BACKGROUND OF THE INVENTION

A two-stroke engine of this kind is disclosed in international patent publication WO98/17901 and includes a combustion chamber defined by a cylinder and delimited by a reciprocating piston. The crankcase is connected to the combustion chamber via a transfer channel. The first end of the transfer channel faces toward the cylinder and opens into the combustion chamber via an entry window lying in the cylinder wall and the lower second end of the transfer channel opens to the crankcase. The entry window of the transfer channel, which lies in the cylinder wall, is controlled by the piston in the manner of a slot control, that is, the entry window is opened or closed in dependence upon the stroke position of the piston.

The air/fuel mixture, which is necessary to operate the engine, is drawn in by suction through a mixture-preparation device and an inlet into the crankcase and, with a downward travel of the piston, is pushed into the combustion chamber via the transfer channels. The transfer channels advantageously lie opposite each other with respect to the cylinder axis. To reduce the exhaust-gas emissions, a fuel-free gas, especially air, is provided in the transfer channels and is supplied via a gas channel to each transfer channel. For this purpose, each transfer channel, between its ends, communicates with an air-conducting gas channel and a check valve configured as a membrane valve.

During the induction stroke, an air/fuel mixture is, on the one hand, inducted into the crankcase via the inlet from the mixture-preparation device when there is an upward travel of the piston in the direction of top dead center. On the other hand, fuel-free air flows in from the gas channel via the transfer channels. For a piston traveling downward in the direction of bottom dead center, the air/fuel mixture is displaced from the crankcase via the transfer channels into the combustion chamber. Because the transfer channels are filled with air, fuel-free air first flows into the combustion chamber ahead of the air/fuel mixture whereby the scavenging losses are reduced. In the following upward stroke, residual amounts of the air/fuel mixture are in the transfer channel from the previous stroke. Because of the position of the check valve between the ends of the transfer channel, a region results in the channel section to the entry window into the combustion chamber which is not scavenged by the air flowing in during the induction stroke. In a following stroke, the residual amounts of the air/fuel mixture therefore flow out of the transfer channels first and only thereafter the air, which is introduced into the transfer channel, and then the air/fuel mixture from the crankcase. The residual portions of the air/fuel mixture, which remain in the transfer channels because of the scavenging dead volume, deteriorate the exhaust-gas emissions.

SUMMARY OF THE INVENTION

It is an object of the invention to provide a two-stroke engine which ensures a complete filling of the transfer channel with an advance quantity of fuel-free gas.

The two-stroke engine of the invention includes a two-stroke engine in a portable handheld work apparatus. The two-stroke engine includes: a cylinder having a cylinder wall; a piston mounted in the cylinder to undergo a reciprocating movement along a stroke path between top dead center and bottom dead center during operation of the engine; the cylinder and the piston conjointly delimiting a combustion chamber; a crankcase connected to the cylinder; a crankshaft rotatably mounted in the crankcase; a connecting rod connecting the piston to the crankshaft to permit the piston to drive the crankshaft as the piston reciprocates in the cylinder; at least one transfer channel connecting the crankcase to the combustion chamber; the transfer channel having a first end defining an entry window opening into the combustion chamber; the entry window being formed in the cylinder wall and being controlled by the piston as the piston moves in the cylinder; the transfer channel having a second end opening into the crankcase; a gas channel for supplying essentially fuel-free gas to the engine; a valve for connecting the gas channel to the transfer channel at a location thereon between the first and second ends; a mixture-preparation device for supplying an air/fuel mixture; an intake channel for conducting the air/fuel mixture into the crankcase; and, means for opening the entry window to the crankcase through an opening cross section at a stroke position of the piston along the stroke path in the region of the top dead center.

The valve can, for example, be a piston-ported control device or a check valve.

The entry window of the transfer channel is open to the crankcase in a stroke position of the piston in the region of top dead center. For this reason, a portion of the fuel-free gas, which flows via the check valve into the transfer channel, flows via the entry window in the cylinder wall to the crankcase and in this way completely scavenges possible residual quantities of an air/fuel mixture from a previous stroke. The transfer channel is completely filled with fuel-free gas, especially air, from its entry window in the cylinder wall to its end open to the crankcase so that, in a subsequent stroke ahead of an inflow of an air/fuel mixture, only fuel-free gas flows into the combustion chamber and scavenges the exhaust gases.

In order to ensure that the fuel-free gas also intensively scavenges the segment of the transfer channel to the crankcase, the opening cross section corresponds only to a portion of the area of the entry window whereby the main flow of the inducted fuel-free gas, namely air, leads from the check valve downwards to the open end of the transfer channel in the crankcase and only a component flow, which is lesser by volume, flows over through the opened entry window into the crankcase. It has been shown to be advantageous to provide an opening cross section of approximately 5% to 45% of the total area of the entry window, and especially 10% to 30% of the total area of the entry window.

In a further embodiment of the invention, a cutout is formed in the piston wall and the cutout lies approximately opposite the entry window in a stroke position of the piston in the region of top dead center. The upper edge of the cutout faces toward the base of the piston and is purposefully approximately at the elevation of the upper edge of the entry window facing toward the cylinder head so that (while considering the elevation of the entry window measured in the stroke direction of the piston) a connection of the transfer channel via the entry window and the cutout in the piston wall to the crankcase is given over a crankshaft angular region ahead of the upper top dead center. Advantageously, the edges lie precisely opposite each other at top dead center of the piston.

In a simple configuration, the cutout is a venting window in the piston wall and is open to the crankcase. The venting window is configured in elevation and/or in width less than the elevation and/or the width of the entry window. Advantageously, the venting window can also be configured as one or several through bores in the piston wall.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
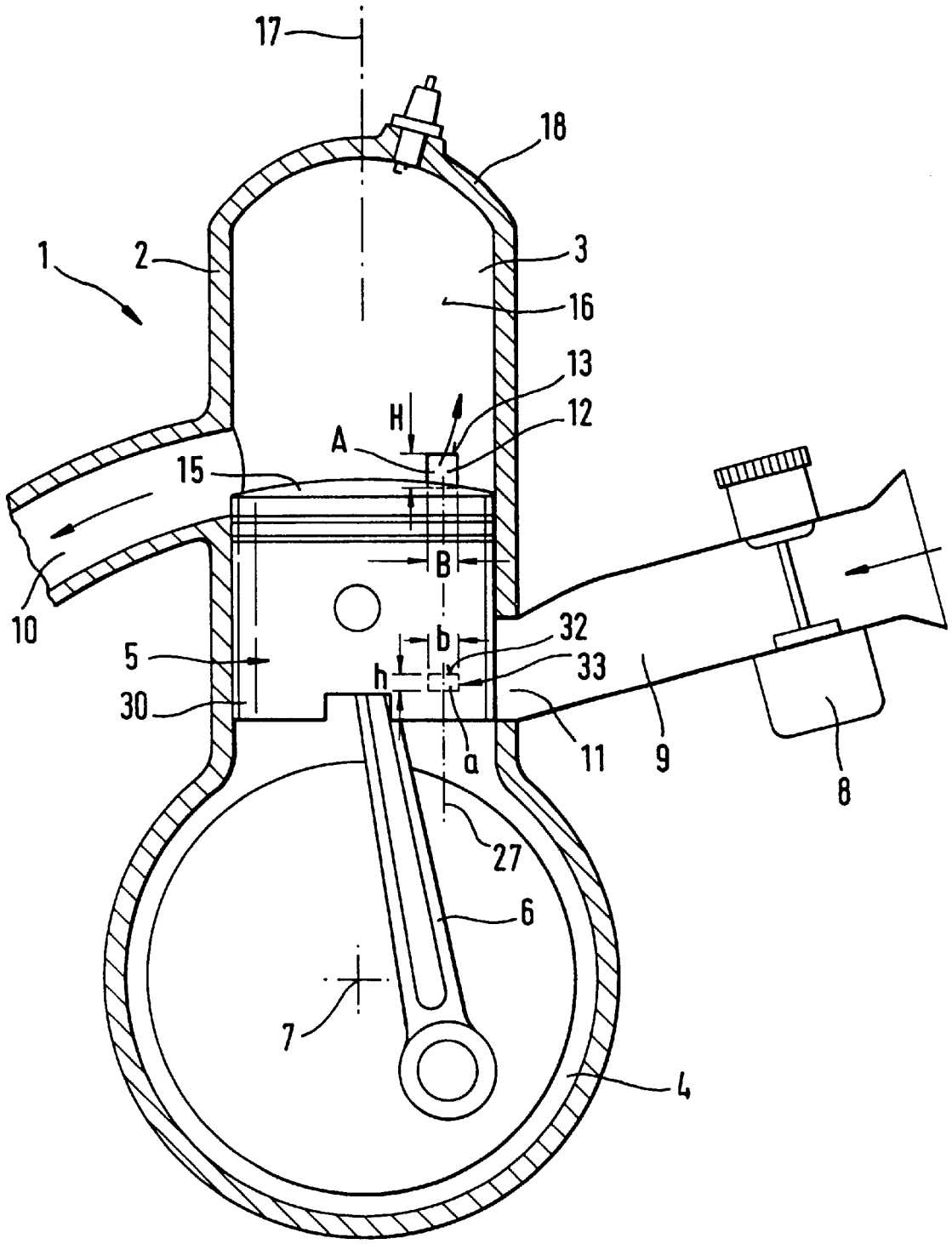
FIG. 1 is a side elevation view, in section, of a two-stroke engine according to the invention provided with two transfer channels.

The two-stroke engine 1 shown in FIG. 1 includes essentially a cylinder 2 and a piston 5 which rotatably drives a crankshaft 7 via a connecting rod 6. The piston 5 moves upwardly and downwardly in the cylinder 2 and the crankshaft 7 is arranged in a crankcase 4.

A combustion chamber 3 is formed in the cylinder 2 and is delimited by the base 15 of the piston 5. The combustion chamber 3 includes an outlet 10 through which combustion gases are directed away after a work cycle, The air/fuel mixture, which is necessary to operate the two-stroke engine 1, is conducted via a mixture-preparation device 8 to the crankcase 4. The mixture-preparation device 8 is preferably a membrane carburetor. For this purpose, the crankcase 4 is connected to the mixture-preparation device 8 via an inlet 11 and an inlet channel 9. In the embodiment shown, the inlet 11 is controlled by the piston surface 30. In the stroke position of the piston 5 shown in FIG. 1, the inlet 11 is completely covered by the piston surface 30. The air/fuel mixture, which is inducted into the crankcase 4, is therefore compressed in a further downward movement of the piston in the direction toward bottom dead center and flows into the combustion chamber 3 via the transfer channel 14 and an entry window 12 in the cylinder wall 16. The transfer channel 14 is shown in detail in FIG. 2.

Figure 2:
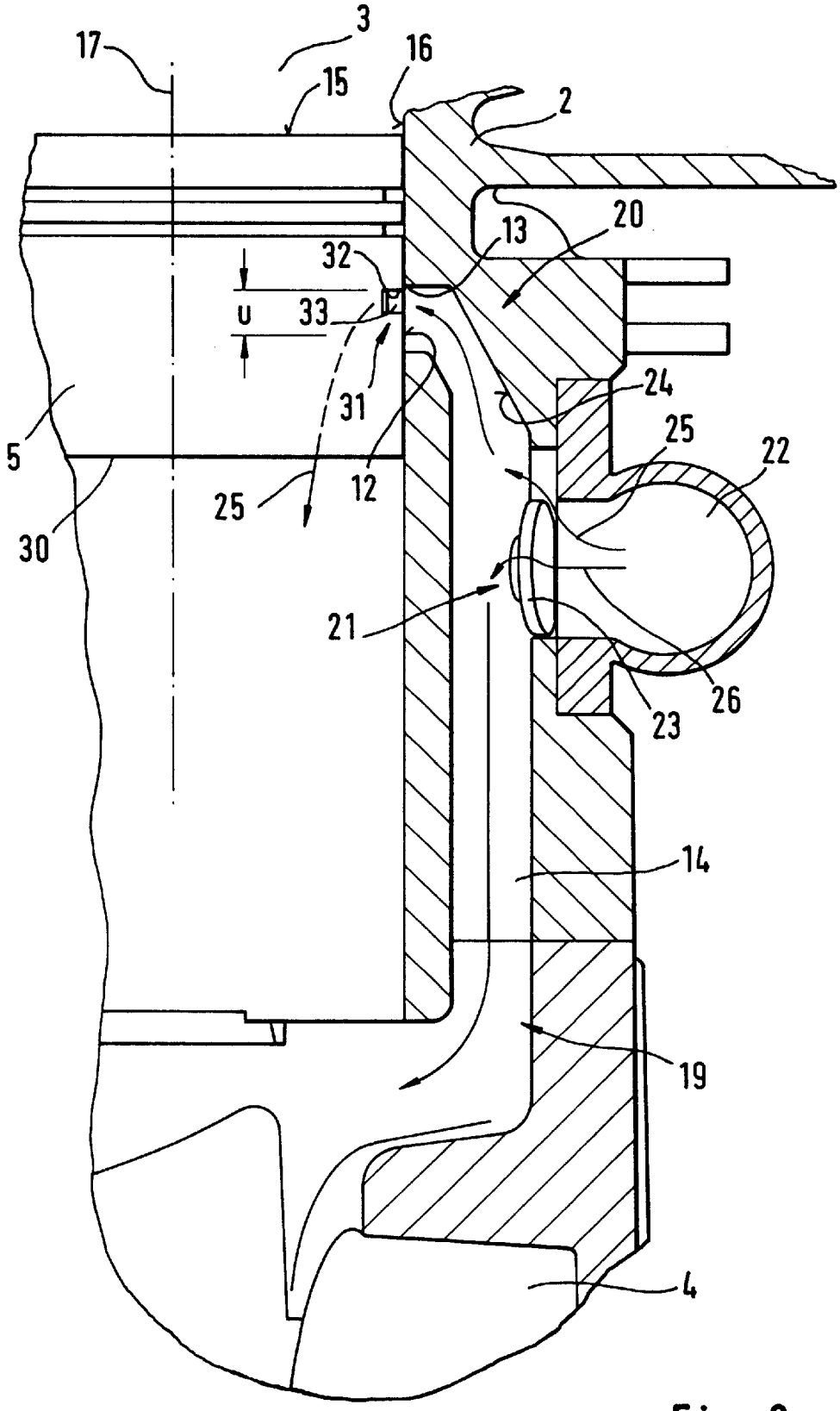
FIG. 2 is a detail view of a longitudinal section through the transfer channel in FIG. 1.

As shown in FIG. 2, the transfer channel 14 runs in the cylinder wall essentially parallel to the cylinder axis 17. The transfer channel can also run curved in the flow direction, that is, the transfer channel can be configured as a curved channel. The first end 20 of the transfer channel 14 faces toward the cylinder head 18 and opens into the combustion chamber 3 via the entry window 12 in the cylinder wall 16; whereas, the second end 19 of the transfer channel 14 faces toward the crankcase 4 and is open toward the crankcase.

The transfer channel 14 is connected to a gas channel 22 between the first end 20 and the second end 19. A valve, for example, a piston-ported control device can be provided and, in the embodiment shown, the valve provided is a check valve 21 which opens toward the transfer channel 14 and closes the flow connection between the gas channel 22 and the transfer channel 14. In the embodiment of FIG. 2, the check valve 21 is configured as a membrane valve. The membrane 23, on the one hand, releases a component flow 25 directed upwardly to the transfer channel roof 24 and, on the other hand, releases a component flow 26 which flows laterally about the membrane 23. The component flow 26 flows off essentially in the direction toward the crankcase 4.

The gas channel 22 can be fixed outside on the cylinder 2 as a separate component while interposing the check valve 21.

The relatively long transfer channel roof 24 is positioned inclined in FIG. 2 and causes, constructively, the check valve 21 to be at a position which is at a corresponding elevation distance from the entry window 12. For this reason, a flow dead zone can form in the induction stroke in the segment of the transfer channel 14 between the check valve 21 and the entry window 12.

The above is countered in that the piston 9 clears the entry window 12 to the crankcase 4 in a position of the piston close to top dead center. In this way, the component flow 25, which is directed upwardly toward the transfer channel roof 24, can pass via the entry window 12 into the crankcase 4. In this way, the channel segment between the check valve 21 and the entry window 12 is effectively filled with an advance quantity of air. Residual components of the air/fuel mixture possibly remaining in this channel segment from a previous stroke are purged into the crankcase 4 via the entry window 12.

The opening of the entry window 12 in the region of top dead center of the piston advantageously takes place via a cutout 31 in the piston wall 30. In the embodiment shown, this cutout is advantageously configured as a venting window 33 open to the piston interior space which communicates with the crankcase 4. In the region of the top dead center position of the piston, the cutout 31 (that is, the venting window 33) lies approximately opposite to the entry window 12 of the transfer channel 14. Here, it is advantageously provided that the upper edge 32 of the cutout 31 lies approximately at the elevation of the upper edge 13 of the entry window 12 as shown. The upper edge 32 lies facing toward the piston base 15 and the upper edge 13 lies facing toward the cylinder head 18 (see FIG. 1). The edges 32 and 13 lie especially at the upper top dead center of the piston so that they are precisely coincident.

The effective cross-sectional area A of the entry window 12 and the effective cross-sectional area (a) of the cutout 31 or of the venting window 33 are so matched to each other that the maximum opening cross section corresponds only to a portion of the area of the entry window 12. A very good effect of the teaching of the invention is achieved when the opening cross section (a) of the cutout 31 or of the venting window 33 has approximately 5% to 45% of the cross-sectional area A of the entry window 12. A purposeful size configuration lies between 10% to 30% of the cross-sectional area A of the entry window 12.

The configuration of the cutout 31 or of the venting window 33 can be as desired when considering the given ratio a:A of the cross-sectional area (a) of the cutout 31 to the cross-sectional area A of the entry window 12 of 5% to 45%. Purposefully, the form corresponds to the geometric form of the entry window 12. In the embodiment of FIG. 1, the cutout 31 or the venting window 33 has an approximately rectangularly-shaped configuration when viewed in plan. The elevation (h) as well as the width (b) of the venting window 33 is purposefully less than the elevation H and the width B of the entry window 12. The form is so selected that both windows exhibit the same symmetry axis 27 parallel to the cylinder axis 17.

It can be advantageous to configure the width (b) of the venting window 33 identical to the width B of the entry window 12 and to configure only the elevation (h) less than the elevation H of the entry window 12. If the elevation (h) of the venting window 33 is configured to be less than the elevation H of the entry window 12 then, as shown in FIG. 2, a stroke (u) results over which the venting window 33 with its total effective cross-sectional area (a) lies opposite the entry window 12. During this crankshaft angle, the component flow 25 flows during the induction stroke into the crankcase 4 via the venting window 33 and the interior space of the piston 5. Residual components of an air/fuel mixture present in the transfer channel are scavenged.

Figures 3, 4:
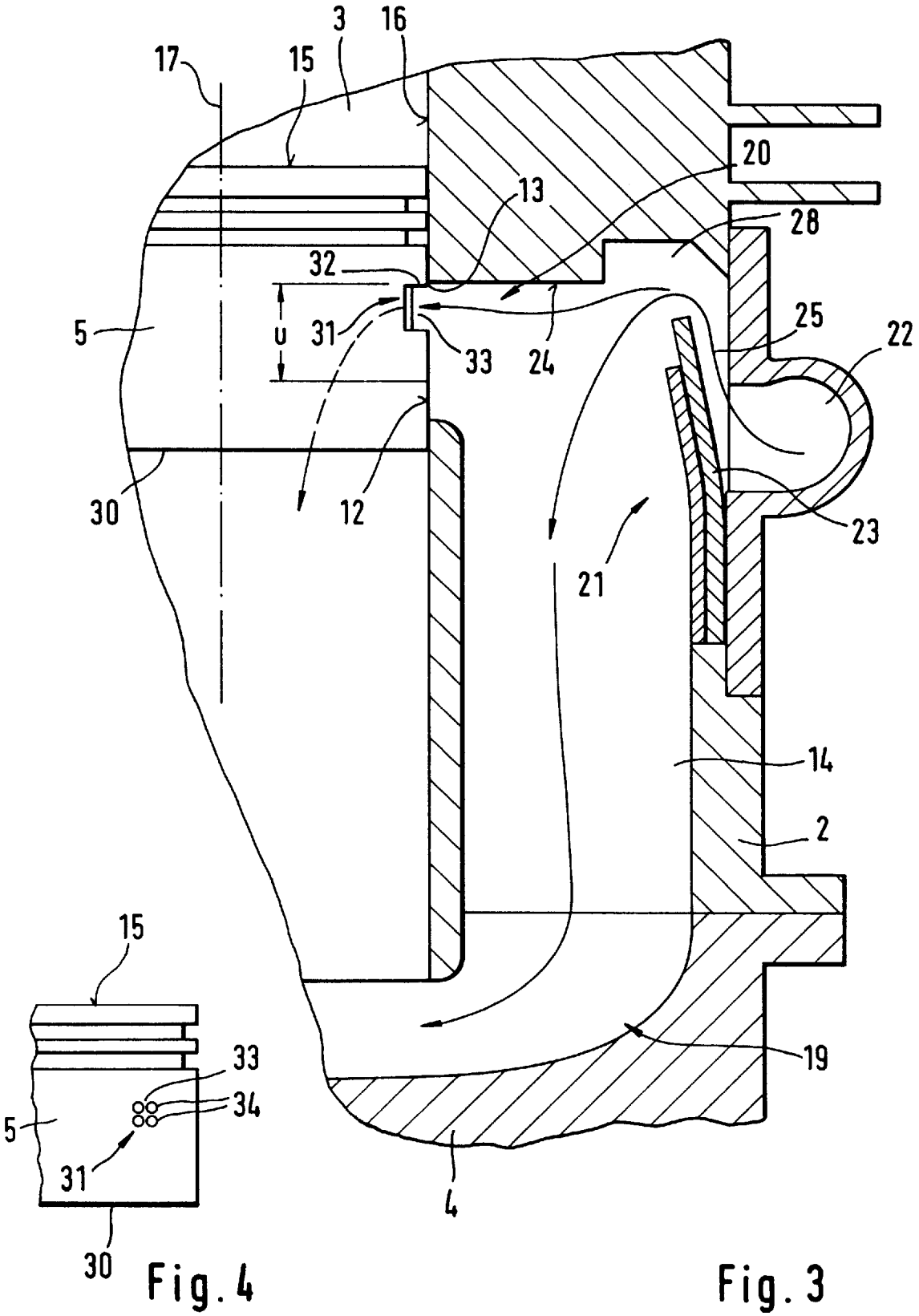
FIG. 3 is a longitudinal section through a transfer channel in accordance with another embodiment of the invention; and, FIG. 4 is a detail view of a portion of the surface of a piston wherein the piston is provided with a venting window configured as several bores.

The embodiment shown in FIG. 3 corresponds in its basic configuration to the embodiment of FIG. 2. For this reason, the same parts are identified by the same reference numerals.

As a departure from FIG. 2, the transfer channel roof 24 is essentially arranged at right angles to the cylinder axis 17 whereby the gas channel 22 can be placed at the periphery of the cylinder 2 at an elevation close to the elevation of the entry window 12. The upwards directed component flow 25 of the fuel-free gas is directed into a recess 28 thereby imparting a swirling movement to the component flow in order to obtain a good scavenging of the channel segment of the transfer channel 14 to the crankcase 4 between check valve 21 and the end 19 of the transfer channel 14. The recess in the roof 24 of the transfer channel, which causes the swirling flow, effects an intense fanning of the inflowing gas flow 25 whereby excellent purging of the transfer channel 14 can be achieved also in the direction of the crankcase 4. The segment of the transfer channel 14 between the membrane valve 21 and the entry window 12 is completely scavenged by the component flow which passes through the venting window 33.

As shown in FIG. 4, the venting window 33 can also be configured as one or several through bores 34 in the piston surface 30. In the configuration of several bores 34, the same diameter can preferably be provided or even different diameters can be provided.

It is understood that the foregoing description is that of the preferred embodiments of the invention and that various changes and modifications may be made thereto without departing from the spirit and scope of the invention as defined in the appended claims.

What is claimed is:

1. A two-stroke engine including a two-stroke engine in a portable handheld work apparatus, the two-stroke engine comprising:

a cylinder having a cylinder wall;

a piston mounted in said cylinder to undergo a reciprocating movement along a stroke path between top dead center and bottom dead center during operation of said engine;

said cylinder and said piston conjointly delimiting a combustion chamber;

a crankcase connected to said cylinder;

a crankshaft rotatably mounted in said crankcase;

a connecting rod connecting said piston to said crankshaft to permit said piston to drive said crankshaft as said piston reciprocates in said cylinder;

at least one transfer channel connecting said crankcase to said combustion chamber;

said transfer channel having a first end defining an entry window opening into said combustion chamber;

said entry window being formed in said cylinder wall and being controlled by said piston as said piston moves in said cylinder;

said transfer channel having a second end opening into said crankcase;

a gas channel for supplying essentially fuel-free gas to said engine;

a valve for connecting said gas channel to said transfer channel at a location thereon between said first and second ends;

a mixture-preparation device for supplying an air/fuel mixture;

an intake channel for conducting said air/fuel mixture into said crankcase; and, means for opening said entry window to said crankcase through an opening of the piston, said opening having a cross section and alinging with said entry window at a stroke position of said piston in the region of said top dead center.

2. The two-stroke engine of claim 1, wherein said opening cross section corresponds to a functional area of said entry window.

3. The two-stroke engine of claim 2, wherein said entry window has a cross-sectional area (A); and, said opening cross section corresponds to 5% to 45% of said cross-sectional area (A).

4. The two-stroke engine of claim 3, wherein said opening cross section corresponds to 10% to 30% of said cross-sectional area (A).

5. The two-stroke engine of claim 1, wherein said piston has a base wall delimiting said combustion chamber and a side wall extending downwardly from said top wall toward said crankcase; and, said side wall having a cutout formed therein defining said opening cross section overlapped by said entry window when said piston is in said stroke position in the region of said top dead center.

6. The two-stroke engine of claim 5, wherein said cutout and said entry window have approximately the same geometric form.

7. The two-stroke engine of claim 5, wherein said cylinder wall has a top wall portion and a side wall portion; said cutout has an upper edge facing toward said base wall of said piston and said entry window has an upper edge facing toward said top wall portion of said cylinder; and, said upper edge of said cutout lying at approximately the elevation of said upper edge of said entry window when said piston is at said stroke position in the region of said top dead center.

8. The two-stroke engine of claim 7, wherein said upper edge of said cutout lies directly opposite said upper edge of said entry window when said piston is at said top dead center.

9. The two-stroke engine of claim 8, wherein said cutout is a venting window open to said crankcase.

10. The two-stroke engine of claim 9, wherein said entry window has a height (H) and a width (B); said venting window has a height (h) and a width (b); and, at least one of said height (h) and said width (b) of said venting window is less than said height (H) and said width (B) of said entry window.

11. The two-stroke engine of claim 9, wherein said cutout is defined by a bore extending through said side wall of said piston.

12. The two-stroke engine of claim 9, wherein said cutout is defined by a plurality of bores extending through said side wall of said piston.

13. The two-stroke engine of claim 1, wherein said valve is a check valve.

14. The two-stroke engine of claim 13, wherein said check valve is a membrane check valve.

* * * * *

UNITED STATES PATENT AND TRADEMARK OFFICE

CERTIFICATE OF CORRECTION

PATENT NO. : 6,257,181 B1
DATED : July 10, 2001
INVENTOR(S) : Heiko Rosskamp and Lars Bergmann It is certified that error appears in the above-identified patent and that said Letters Patent is hereby corrected as shown below:

Title page,
ABSTRACT,
Line 8, delete "piston".
Line 9, between "the" and "(5)", insert -- piston --.

Column 6,
Line 7, delete "alinging" and substitute -- aligning -- therefor.

Signed and Sealed this

Twelfth Day of March, 2002

*Attest:*

*Attesting Officer*

JAMES E. ROGAN
*Director of the United States Patent and Trademark Office*